US005199681A

United States Patent [19]

Reidy

[11] Patent Number: 5,199,681

[45] Date of Patent: Apr. 6, 1993

[54] BRACKET SYSTEM FOR MOUNTING POSTERS ON WALLS

[76] Inventor: Mark M. Reidy, 718 Grant St., No. 9, Denver, Colo. 80203

[21] Appl. No.: 826,004

[22] Filed: Jan. 27, 1992

[51] Int. Cl.[5] ..... A47F 1/14

[52] U.S. Cl. ..... 248/488; 40/156; 240/216.1; 240/220.1; 240/468

[58] Field of Search ..... 248/488, 468, 475.1, 248/220.1, 216.1, 220.2, 222.1, 225.1; 40/156, 611

[56] References Cited

U.S. PATENT DOCUMENTS

| | | | |
|---|---|---|---|
| 2,532,162 | 11/1950 | Goss | 248/488 X |
| 3,049,323 | 8/1962 | Peterka | 248/488 X |
| 3,478,997 | 11/1969 | Goss | 248/488 |
| 4,176,480 | 12/1979 | Euzarraga et al. | 40/156 X |
| 4,187,630 | 2/1980 | Giulie et al. | 40/156 |
| 4,204,350 | 5/1980 | Brenner | 40/156 X |
| 4,673,152 | 6/1987 | Brown | 248/488 X |
| 5,012,601 | 5/1991 | Garland et al. | 40/156 X |
| 5,109,619 | 5/1992 | Noggle | 40/156 X |

FOREIGN PATENT DOCUMENTS

| | | | |
|---|---|---|---|
| 0020461 | 4/1893 | United Kingdom | 248/488 |

*Primary Examiner*—Ramon O. Ramirez

[57] ABSTRACT

The bracket system comprises specially shaped corner components which include an angled slot for receiving the corner of the poster to be mounted. A locking mechanism comprising a pair of members which rotate relative to one another are inserted in the slot behind the poster corner. The locking members include ramped surfaces which engage one another to expand them outwardly and grip the poster corner in the slot. Thus, the poster is firmly gripped in the corner component. A tack like protrusion carried on the back side of the corner component is used to fasten the resulting assembly to a wall surface in a conventional manner, while leaving the poster undamaged.

9 Claims, 2 Drawing Sheets

BRACKET SYSTEM FOR MOUNTING POSTERS ON WALLS

BACKGROUND OF INVENTION

1. Field of Invention

The present invention relates to a mounting bracket system for mounting posters or like objects to walls.

2. Description of Prior Art

Until now, when one wanted to mount a poster on a wall, one has had relatively few inexpensive ways of doing so.

Of course the most obvious means of mounting a poster on a wall is the conventional frame system. One drawback to this means is the relatively high price of most frames as compared with that of a typical wall poster. At times the price of the frame can be several times that of the poster itself.

Another drawback to the conventional frame is that it must be at least as large as the poster to be mounted and often requires to be custom made to fit the poster.

Yet another drawback to the conventional frame is the difficulty in transporting them due to their size and fragility.

A different means of mounting a poster to a wall is the simple thumbtack. While thumbtacks are inexpensive, they also damage the poster by piercing holes through it.

Another means of mounting a poster to a wall is through the use of adhesive tape. One problem with tape is that when one wants to remove the poster from the wall the tape tends to peel paint off the wall. Also, when the tape is removed from the poster it can peel some of the poster backing material with it, damaging the poster. Furthermore, some tapes tend to lose their adhesive properties over time.

While there are many other means of mounting posters, they are usually limited by one or more of the following factors: relatively expensive in comparison to the poster itself; needs to be relatively the same size as the poster and/or needs to be custom fitted; damage the poster in some way; do not transport easily due to size and/or fragility.

Hence, there remains a need for a means of mounting posters to walls which overcomes these limitations.

OBJECTS OF THE INVENTION

Accordingly, objects and advantages of my invention include:

To provide a mounting system which securely mounts a poster to a wall.

To provide a mounting system which fits many different size posters without the need for adjustments or alterations.

To provide a mounting system which does not damage the poster.

To provide a mounting system which is relatively inexpensive as compared with the cost of a wall poster.

To provide a mounting system which is compact and therefor easy to transport.

BRIEF DESCRIPTION OF THE INVENTION

Accordingly, this invention includes a mounting bracket for attaching a poster to a wall surface. The mounting bracket comprises a first means for engaging a first side of the poster, second means for engaging the second side of the poster at a position on said poster opposite said first means, and fastening means for attaching said first means and said second means to said wall surface. The first means comprises a corner component having a first leg, a second leg substantially perpendicular to said first leg, a slot in said corner component for receiving a corner portion of said poster. The second means comprises a friction pad and a locking mechanism mounted in the slot, a lever attached to said locking mechanism and extending from said slot. This lever is sized to be operated by ordinary finger pressure to bring said first and second means to grippingly engage respective first and second sides of said poster. Preferably, the fastening means is a penetrating fastener, like the shaft of a thumbtack or the like.

Preferably, the locking mechanism comprises a member that includes a ramped surface attached to the lever. The friction pad has a first surface engaging the ramped surface on the member. Thus, this member may be rotated relative to said friction pad when said lever is turned by finger pressure to slide the ramped surface along the second surface of said friction pad. In this way, the locking mechanism wedges outwardly to grip the poster between the corner component and the friction pad.

The invention also includes a mounting bracket system for attaching a generally flaccid web-like member to a wall for display purposes, such as for attaching a poster or the like to a dwelling wall. The system comprises a plurality of separate corner attaching members for holding said web in close proximity to the wall. At least one of the corner attaching members includes means for gripping a corner portion of the web whereby said corner portion is attached to said corner attaching member, and a tack like penetrating shaft attached to the corner attaching member. The tack like members extend substantially perpendicular to the web, whereby said shaft can be pushed into the wall and the web is thereby attached to the wall.

This corner member includes first and second legs, and a slot in these legs sized to receive a corner of the web. The gripping means is operatively positioned in the slot together with the corner of the web to be mounted to the wall.

DETAILED DESCRIPTION OF THE PREFERRED EMBODIMENT

Figure 1:
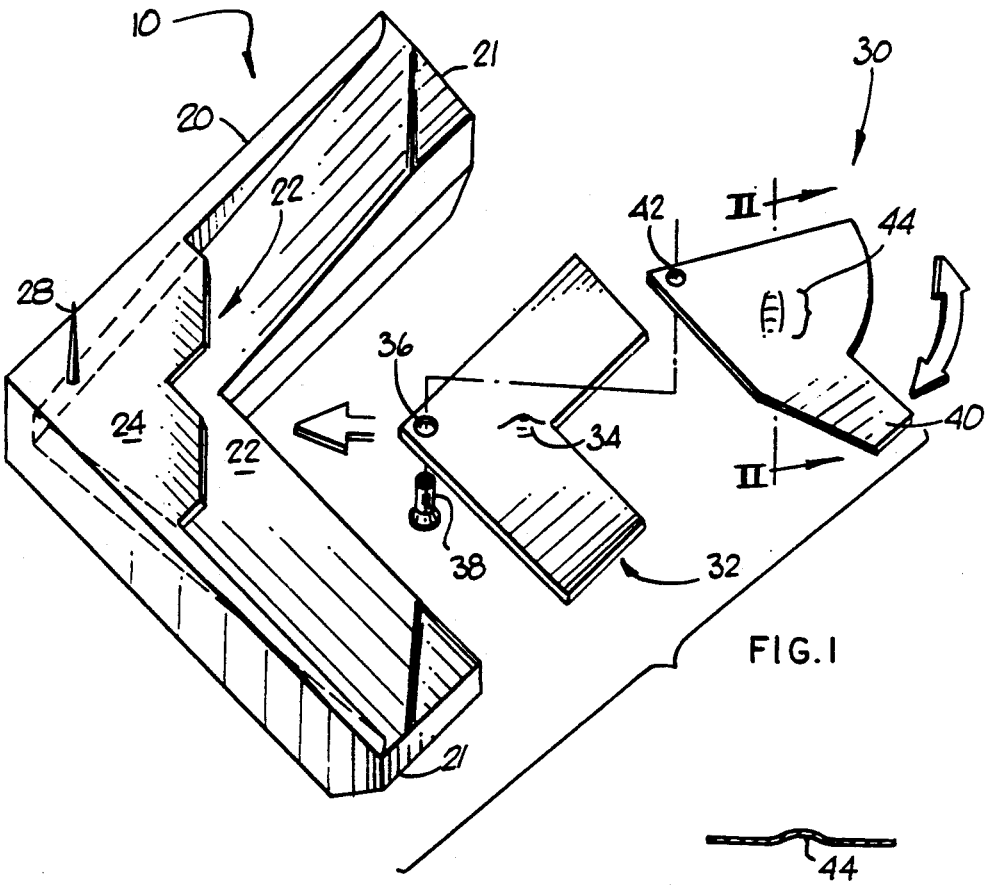
FIG. 1 is a rear perspective of the preferred embodiment showing its components in exploded view.
Figure 2:
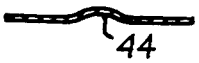
FIG. 2 is a sectional view along lines II—II of FIG. 1.

The figures show the corner component 20 of the device 10. Preferably made of a single piece of molded plastic, the corner component 20 is shaped in the form of a right angle. Extending outwards, perpendicular to each other are two legs 21 and 21.

A slot 22 intrudes o the underside of the corner component 20 in a slight angle towards the inside corner of the corner component 20. Thus, the slot 22 extends from where it is embedded in the corner component 20 at the intersection of the legs 21, to a position adjacent to the ends of the legs 21 where the slot tapers to merge with a plane. This plane corresponds to the surface of the wall to which the bracket would be attached via a thumbtack-like fastener 28.

A tang 24 which defines the lower portion of slot 22 may have a series of concentric grooves 26 or other friction enhancing surface treatment in its surface facing slot 22.

Imbedded in tang 24 is the tack-like fastener 28. The shaft portion of fastener 28 protrudes from the bottom of the tang 24 and extends generally perpendicular to the arms 21.

Figure 5:
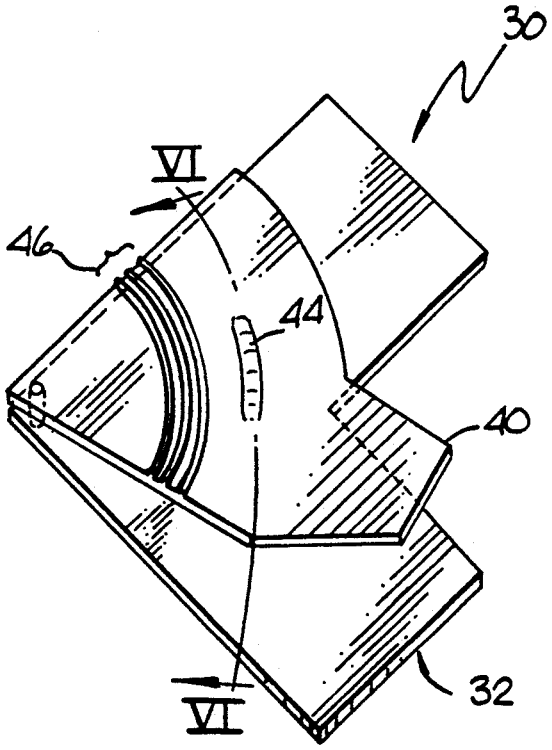
FIG. 5 is a perspective view of the locking mechanism shown in the previous figures.

FIG. 1 shows the locking mechanism component 30 of the device disassembled (or exploded) for clarity. The friction pad 32 of the locking mechanism 30 has a non-skid texture on its bottom side. In the approximate center of the friction pad 32 is a detent or protrusion 34. Near the outside corner of the friction pad 32 is a hole 36 through which a flanged rivet 38 is inserted through a corresponding hole 42 in lever 40. In the approximate center of the lever 40 there is a ramped surface 44 into which the detent 34 in the base fits in the unlocked position, shown in FIG. 6. On the upper surface of the lever 40 are a series of slightly raised concentric ridges 46 (FIG. 5).

The operation of the preferred embodiment is quite simple. Preferably four of these mounting brackets are used to mount a poster P or similar object to the wall W although two, (one on each of the uppermost corners) may suffice for certain applications.

Figure 4:
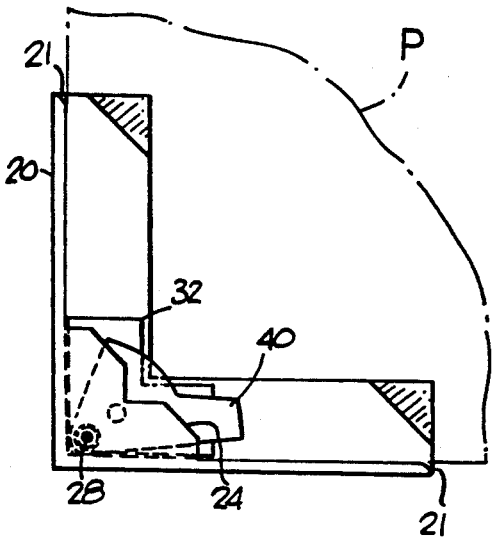
FIG. 4 is a plan view of the preferred embodiment.
Figure 6:
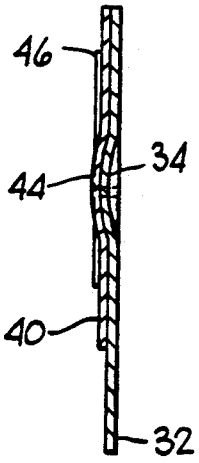
FIG. 6 is a sectional view along IV—IV of FIG. 5.

To fastener the devices to each corner portion of a poster P, one proceeds in the following manner. The user first places the poster, face down, on a flat surface, such as the floor. Next, the user holds the corner component 20 face down, as shown in FIG. 4. The user then slides a corner of the poster into the slot 22 in the corner component 20, making sure that the corner of the poster is fully inserted into the slot 22 with the edges of the poster contacting the outer sides of the slot 22. Next, the user holds the locking mechanism 30, in the unlocked position (that is, with the detent 34 aligned with the cavity formed by ramped surface 44) as shown in FIG. 5 and 6, with the base 32 facing downwards. The user then slides the locking mechanism 30 fully into the slot 22 in the corner component 20 between the tang 24 and the back surface of the poster P. The user then locks everything in place by moving the lever 40 in a clockwise direction until the leading edge of the lever 40 makes contact with the outer sides of the slot 22. The user repeats this procedure on the three remaining corners of the poster.

Figure 3:
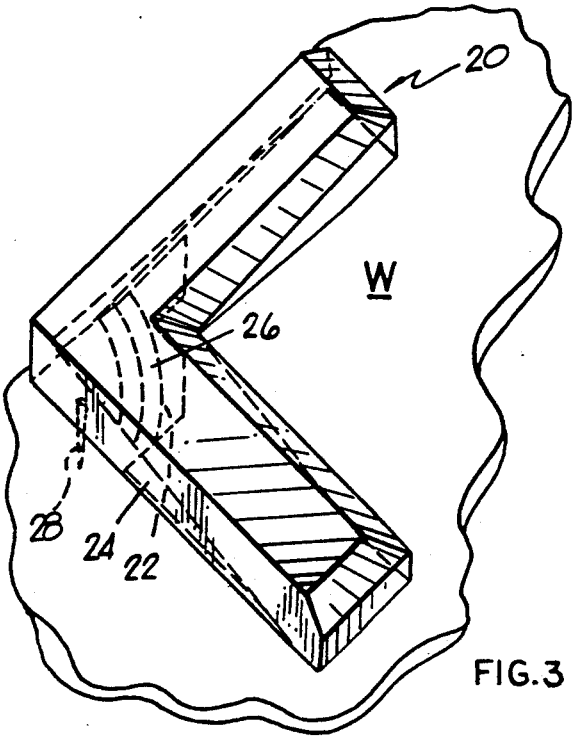
FIG. 3 is from a perspective view of the preferred embodiment.

The poster is locked in place by the compressing action, of the locking mechanism 30 against it. The textured bottom of the base friction pad 32 of the locking mechanism 30 further prevents the poster from slipping out of the assembly. When set in the locked position, the raised ridges 46 of the lever 40 mate with the grooves 26 (FIG. 3) on the inner surface of the tang 24. Though not necessary, this interaction helps prevent the locking mechanism 30, and the poster along with it from slipping out of the slot 22.

Next, the user mounts the poster, with the four mounting brackets attached, to the wall. First, the user holds the poster up to the wall, face out, in the place desired. Next the user pushes the fastener 28 on one of the top corners into the wall until it is fully imbedded in the wall. Next the user pushes the other top corner in the wall making sure that the top edge of the poster is horizontal and is laying flat against the wall. The remaining two corners are pressed into the wall one at a time making sure that the poster is laying flat against the wall.

This invention has advantages when compared to a conventional poster frame in that it uses less material to construct and therefor is generally less expensive to manufacture. This invention will fit many different sizes of posters without having to be altered, where as conventional poster frames must be relatively the same size as the poster to be hung, and are therefor not as universal. A further advantage of this invention is its small size, making it easy to store and/or transport.

The advantage this invention has over ordinary thumbtack is that it does not damage the poster by piercing holes through it.

The advantage this invention has over tape is that it can be easily removed from the wall with very minor damage to the wall, i.e. four very small holes. This invention can then be removed from the poster with no damage to the poster. Tape on the other hand tends to peel paint off the wall when removed from it. Also, tape tends to peel some of the backing material off the poster when removed from the poster.

The reader will find further objects and advantages of the invention from a consideration of the ensuing description and the accompanying drawings.

I claim:

1. A mounting bracket for attaching a poster to a wall surface, the poster having a front side and a back side and at least one corner portion, the bracket comprising:
   - first means for engaging the front side of the poster comprising a corner component having a first leg, a second leg forming an angle to the first leg, and a slot in said corner component for receiving the corner portion of the poster,
   - second means for engaging the back side of the poster, said second means consisting of a locking means, said locking means having friction pad for contacting the back side of the poster, a lever pivotally mounted on the friction pad to bring the first means and said friction pad to grippingly engage the sides of the poster, and
   - fastening means for attaching the first and second means to the surface.

2. A mounting bracket as set forth in claim 1 wherein said second means is mounted in said slot.

3. A mounting bracket as set forth in claim 1 wherein said locking mechanism further comprising
   - a member attached to said lever, said member including a ramped surface,
   - said friction pad having a first surface for gripping said back side of said poster and a second surface engaging said ramped surface on said member, whereby said member may be rotated relative to said friction pad when said lever is turned by finger pressure to slide said ramped surface along said second surface of said friction pad such that said locking mechanism wedges outwardly to grip said poster between said corner component and said friction pad.

4. A mounting bracket as set forth in claim 1 wherein said means for attaching comprises a penetrating fastener mounted to said corner component and extending substantially perpendicular to said first and second legs.

5. A mounting bracket as set forth in claim 4 wherein said slot extends at a slight angle from a position close to the intersection of said first and second arms where said slot is embedded in said corner bracket to a position adjacent to the ends of the arms where said slot tapers to merge with a plane defined by said wall to which said bracket is to be attached.

6. A mounting bracket system for attaching a generally flaccid web-like member to a wall for display purposes, comprising a plurality of separate corner attaching members for holding said web in close proximity to said wall, each of said corner attaching members including means for gripping the front and back surfaces of a corner portion of said web whereby said corner portion may be grippingly attached to said corner attaching member, a tack like penetrating shaft attached to said corner attaching member and extending substantially perpendicular to said web, whereby said shaft can be pushed into said wall and said web is thereby attached to said wall, and means for holding most of said web generally flat against the surface of said wall when said penetrating shaft is pushed into said wall and said web is thereby attached to said wall.

7. A system for attaching a generally flaccid, web-like member to a wall for display purposes as set forth in claim 6 wherein said corner member includes first and second legs, a slot in said legs sized to receive a corner of said web, said means for gripping being operatively positioned in said slot together with said corner of said web.

8. A system for attaching a generally flaccid, web-like member to a wall for display purposes as set forth in claim 7 wherein said means for gripping comprises two generally flat members with mutually engaging ramped surfaces such that when said flat members a removed relative to one another they move generally away from one another by the wedging action of said ramped surfaces, and whereby said corner of said web is gripped between one of said flat members and said corner member.

9. A system for attaching a generally flaccid, web-like member to a wall for display purposes as set forth in claim 7 wherein said means for holding most of said poster generally flat against the surface of said wall when said penetrating shaft is pushed into said wall and said web is thereby attached to said wall comprises said slot, and said slot is generally planar and set at an acute angle relative to the normal plane of said web a when displayed in said wall, said slot generally intersecting the plane of said wall at the remote ends of said legs.

* * * * *